US010370840B2

(12) United States Patent
Huber

(10) Patent No.: US 10,370,840 B2
(45) **Date of Patent: *Aug. 6, 2019**

(54) DRAIN AND DRAIN LEVELING MECHANISM

(71) Applicant: The Drain Company, LLC, Tacoma, WA (US)

(72) Inventor: Donald G. Huber, Tacoma, WA (US)

(73) Assignee: The Drain Company, LLC, Tacoma, WA (US)

( * ) Notice: Subject to any disclaimer, the term of this patent is extended or adjusted under 35 U.S.C. 154(b) by 923 days.

This patent is subject to a terminal disclaimer.

(21) Appl. No.: 14/795,407

(22) Filed: Jul. 9, 2015

(65) Prior Publication Data

US 2016/0010320 A1 Jan. 14, 2016

Related U.S. Application Data

(60) Provisional application No. 62/023,685, filed on Jul. 11, 2014.

(51) Int. Cl.
*E03F 5/04* (2006.01)

(52) U.S. Cl.
CPC .... *E03F 5/0407* (2013.01); *E03F 2005/0413* (2013.01); *E03F 2005/0414* (2013.01)

(58) Field of Classification Search
CPC ..... E03F 5/0407; E03F 2005/0414; E03F 2005/0413; E03F 5/06; E03F 2005/063
USPC ..... 210/164, 166; 52/302.1
See application file for complete search history.

(56) References Cited

U.S. PATENT DOCUMENTS

| | | | | |
|---|---|---|---|---|
| 1,766,621 A | | 6/1930 | Fleming | |
| 1,792,345 A | | 2/1931 | Williams | |
| 2,190,532 A | | 2/1940 | Lukomski | |
| 2,490,075 A | | 12/1949 | Matheis | |
| 2,626,674 A | * | 1/1953 | Boosey | E03F 5/0408 210/165 |
| 2,629,457 A | | 2/1953 | Baker | |
| 2,749,999 A | | 6/1956 | Schmid | |

(Continued)

FOREIGN PATENT DOCUMENTS

| | | | | |
|---|---|---|---|---|
| CA | 2686031 A1 | * | 5/2011 | E03F 5/06 |
| CN | 203307900 | | 11/2013 | |

(Continued)

OTHER PUBLICATIONS

International Search Report and Written Opinion dated Oct. 1, 2015 in PCT/US2015/039807.

*Primary Examiner* — Michael Safavi
(74) *Attorney, Agent, or Firm* — Knobbe Martens Olson & Bear LLP

(57) ABSTRACT

An adjustable floor drain apparatus includes a housing configured for positioning adjacent a drain pipe, a leveling frame configured to be positioned at least partially above the housing, a grate configured to be positioned at least partially above the leveling frame and secured to the leveling frame, and a leveling member. The leveling member can be configured such that actuating the leveling member adjusts the position of the grate relative to the housing while the leveling member remains fixed relative to the housing. The leveling member can be configured such that actuating the leveling member moves the leveling member relative to the grate and adjusts the position of the grate relative to the housing.

21 Claims, 10 Drawing Sheets

(56) References Cited

U.S. PATENT DOCUMENTS

| | | | | |
|---|---|---|---|---|
| 2,783,852 | A | 3/1957 | Sisk | |
| 2,859,452 | A | 11/1958 | Seewack | |
| 2,889,928 | A | 6/1959 | Sisk | |
| 3,228,083 | A | 1/1966 | Gardner et al. | |
| 3,246,582 | A | 4/1966 | Wade et al. | |
| 4,067,072 | A | 1/1978 | Izzi | |
| 4,092,745 | A | 6/1978 | Oropallo | |
| 4,146,939 | A | 4/1979 | Izzi | |
| 4,402,625 | A | 9/1983 | Rechkin | |
| 4,505,814 | A | 3/1985 | Marshall | |
| 4,694,513 | A | 9/1987 | Kiziah | |
| 4,871,451 | A | 10/1989 | Piskula | |
| 4,879,771 | A | 11/1989 | Piskula | |
| 4,883,590 | A * | 11/1989 | Papp | E03F 5/0407 210/164 |
| 5,022,430 | A * | 6/1991 | Degooyer | E03F 5/0407 137/362 |
| 6,179,518 | B1 | 1/2001 | Suatac | |
| 6,269,495 | B1 | 8/2001 | Sondrup | |
| 6,350,373 | B1 | 2/2002 | Sondrup | |
| 6,381,775 | B1 | 5/2002 | Sondrup | |
| 6,687,825 | B1 | 2/2004 | Challener et al. | |
| 6,687,925 | B2 | 2/2004 | Minnick | |
| 6,766,545 | B2 | 7/2004 | Hodges | |
| 7,658,043 | B2 | 2/2010 | Wroblewski | |
| 7,735,512 | B1 | 6/2010 | Ismert et al. | |
| 7,964,095 | B1 * | 6/2011 | Graybeal | E03F 5/04 210/164 |
| 8,347,424 | B2 | 1/2013 | Wroblewski et al. | |
| 8,347,906 | B1 | 1/2013 | Ismert et al. | |
| 8,658,033 | B2 * | 2/2014 | Farkas | E03F 5/04 210/163 |
| 8,881,490 | B2 | 11/2014 | Wroblewski et al. | |
| 9,453,331 | B1 * | 9/2016 | Buffington | E03F 5/041 |
| 9,834,894 | B1 * | 12/2017 | Reed | E01C 11/227 |
| 2002/0148039 | A1 * | 10/2002 | Minnick | E03F 5/0407 4/613 |
| 2003/0159211 | A1 | 8/2003 | Hodges | |
| 2009/0223884 | A1 * | 9/2009 | Wroblewski | E03F 5/0407 210/163 |
| 2011/0168711 | A1 * | 7/2011 | Coscarella | E03F 5/06 220/315 |
| 2011/0173747 | A1 * | 7/2011 | Evans | E03F 5/0407 4/679 |
| 2012/0025517 | A1 | 2/2012 | Majocka et al. | |
| 2014/0020174 | A1 * | 1/2014 | Evans | E03F 5/0407 4/679 |
| 2014/0157514 | A1 | 6/2014 | Cook | |

FOREIGN PATENT DOCUMENTS

| | | | | |
|---|---|---|---|---|
| DE | 9400242 | U1 * | 3/1994 | E01C 11/227 |
| DE | 9421582 | U1 * | 3/1996 | E01C 11/227 |

* cited by examiner

DRAIN AND DRAIN LEVELING MECHANISM

INCORPORATION BY REFERENCE TO ANY PRIORITY APPLICATIONS

Any and all applications for which a foreign or domestic priority claim is identified in the Application Data Sheet as filed with the present application, are hereby incorporated by reference in their entirety under 37 CFR 1.57. This application claims the benefit of priority under 35 U.S.C. § 119(e) of U.S. Provisional Application No. 62/023,685, filed on Jul. 11, 2014, and entitled "DRAIN AND DRAIN LEVELING MECHANISM," the entire disclosure of which is incorporated herein by reference.

BACKGROUND

Field of the Disclosure

The present disclosure relates in general to adjustable drains. Such drains can be used in buildings, floors, basements, exterior areas or other areas that require drainage, as well as for urinals and other waste handling devices connected to a sewer or drain conduit. Such drains can also be used for clean outs.

Description of the Related Art

Many varieties of adjustable drains exist, employing a variety of adjustment mechanisms. However, such devices and certain components thereof have various limitations and disadvantages.

SUMMARY OF THE DISCLOSURE

Various embodiments described herein relate to floor drains that can be used to funnel liquids from a surface, such as a floor, and into a drain pipe. Floor drains typically have a grate or plate that allows fluids to flow through the drain and into the drain pipe, but that prevent larger solid objects from entering the floor drain. Floor drains are typically installed around a drain pipe when a floor surface is being prepared. As used herein, the term "floor" is understood to mean any surface that may accumulate fluids to be drained. Thus, it may include elevated surfaces such as ledges in addition to standard flooring.

It is often desirable for a floor drain to be relatively flush with the level of the floor, thereby preventing accidental injuries from objects catching on a lip of the drain or the floor or other inconveniences associated with a floor drain that rises above or is set below the level of the floor. In many instances, modifications to a floor, such as adding, modifying, or removing a floor surface, may adjust the height of the floor. Additionally, a floor may not always be completely level relative to the drain pipe. In these instances, it can be desirable to provide a floor drain that can be adjusted in height and/or angle. Such a floor drain can be adjusted to help ensure that the plate remains generally level with the floor. Additionally, in various embodiments it can be desirable for an adjustable floor drain to be easily and quickly adjustable with minimal steps.

Various embodiments described herein present the advantage of allowing for adjustment of the height and/or angle of a floor drain grate without having to remove the grate from an adjustable drain apparatus. This can increase the ease and efficiency of adjusting the floor drain.

Various embodiments described herein provide additional features to improve the ease and efficiency of adjusting a floor drain apparatus. In some embodiments, a floor drain assembly or apparatus can include a leveling member that can be used to adjust the height and/or angle of a grate and that can simultaneously be used to attach different components of the floor drain assembly to each other. As a result, in some embodiments adjusting the height and/or angle of the grate requires the manipulation of no more than 3 screws.

In various embodiments, an adjustable floor drain apparatus can include a cylindrical collar comprising a threaded outer surface and an inward projection lip, the collar configured to be positioned at least partially around a drain pipe with the lip positioned over an end of the drain pipe. The apparatus can also include a cylindrical housing comprising a threaded inner surface configured to engage the threaded outer surface of the collar, the housing further comprising a plurality of receiving shafts, each receiving shaft having a bottom, an open top, and an open outer wall. The apparatus can include a plurality of plates, each plate positioned within a receiving shaft and offset from the bottom of the shaft, each plate comprising a channel, and a leveling frame comprising a ring and a plurality of locking blocks extending below the ring, each of the plurality of locking blocks configured to be positioned within a corresponding receiving shaft of the housing and comprising a threaded vertical bore. The apparatus can include a plurality of leveling screws, each of the at least three leveling screws comprising a head at a first end and a threaded shaft with a tool receiving cutout at a second end, each of the at least three leveling screws configured to be positioned in a respective receiving shaft of the plurality of receiving shafts with the head between a respective plate of the plurality of plates and the bottom of the respective receiving shaft, and with the shaft threadably engaged within the threaded vertical bore of the locking block positioned within the respective receiving shaft. The apparatus can also include a grate securable to the frame, the grate comprising a plurality of openings, each of the plurality of openings to be aligned with the threaded bore of a respective one of the plurality of locking blocks.

In various embodiments, an adjustable floor drain apparatus can include a cylindrical collar comprising a threaded outer surface and an inward projection lip, the collar configured to be positioned at least partially around a drain pipe with the lip positioned over an end of the drain pipe. The apparatus can also include a cylindrical housing comprising a threaded inner surface configured to engage the threaded outer surface of the collar, the housing further comprising a circumferential channel having an open top, an outer side wall, an inner side wall, and a bottom. The apparatus can include at least three plates positioned within the circumferential channel and offset from the bottom of the channel, each plate positioned adjacent an opening in the inner side wall of the circular channel and having a cutout. The apparatus can include a leveling frame comprising a ring, a fin projecting downward from the ring along a circumference of the ring, and at least three locking blocks extending radially inward from the fin, each of the at least three locking blocks comprising a threaded vertical bore configured to be aligned with a cutout of one of the at least three plates. The apparatus can also include at least three leveling screws, each of the at least three leveling screws comprising a head at a first end and a threaded shaft with a tool receiving cutout at a second end, each of the at least three leveling screws configured to be positioned with the head between a respective plate of the at least three plates and the bottom of the circumferential channel, and with the shaft threadably engaged within the threaded vertical bore of the locking block aligned with the respective plate of the at least three plates. The apparatus can also include a grate securable to the frame, the grate comprising a plurality of openings, with an opening configured to be aligned with each of the at least three locking blocks of the leveling frame.

In various embodiments, an adjustable floor drain apparatus can include a housing configured for positioning adjacent a drain pipe, a leveling frame configured to be positioned at least partially above the housing, a grate configured to be positioned at least partially above the leveling frame and secured to the leveling frame, and a leveling member, wherein the leveling member is configurable such that actuating the leveling member adjusts the position of the grate relative to the housing while the leveling member remains fixed relative to the housing.

In various embodiments, an adjustable floor drain apparatus can include a housing configured for positioning adjacent a drain pipe, a frame configured to be positioned adjacent the housing, a grate configured to be positioned at least partially above the frame, and a leveling member configured for attachment to the frame, wherein actuating the leveling member moves the leveling member relative to the grate and adjusts the position of the grate relative to the housing.

In various embodiments, a method of operating an adjustable floor drain apparatus to adjust a height of a grate of the floor drain apparatus relative to a housing of the floor drain apparatus can include providing a floor drain apparatus comprising a housing positioned adjacent a drain pipe, a leveling frame positioned at least partially above the housing and attached to the housing, a grate positioned at least partially above the leveling frame and secured to the leveling frame, and a first leveling member, a second leveling member, and a third leveling member. The method can also include actuating first leveling member, actuating the second leveling member, and actuating the third leveling member, wherein the first leveling member, second leveling member, and third leveling member are actuated while the housing is fixed relative to the leveling frame.

In various embodiments, a method of operating an adjustable floor drain apparatus to adjust a height of a grate of the floor drain apparatus relative to a housing of the floor drain apparatus can include providing a floor drain apparatus comprising a housing positioned adjacent a drain pipe, a leveling frame positioned at least partially above the housing, a grate positioned at least partially above the leveling frame and secured to the leveling frame, and a first leveling member, a second leveling member, and a third leveling member. The method can include actuating first leveling member, actuating the second leveling member, and actuating the third leveling member, wherein the first leveling member, second leveling member, and third leveling member are actuated while the grate is attached to the leveling frame.

BRIEF DESCRIPTION OF THE DRAWINGS

Elements in the figures have not necessarily been drawn to scale in order to enhance their clarity and improve understanding of these various elements and embodiments described herein. Furthermore, elements that are known to be common and well understood to those in the industry are not depicted in order to provide a clear view of the various embodiments described herein, thus the drawings are generalized in form in the interest of clarity and conciseness.

DETAILED DESCRIPTION

In the following discussion that addresses a number of embodiments and applications, reference is made to the accompanying drawings that form a part hereof, and in which is shown by way of illustration specific embodiments in which the embodiments described herein may be practiced. It is to be understood that other embodiments may be utilized and changes may be made without departing from the scope of the disclosure.

Various inventive features are described below that can each be used independently of one another or in combination with other features. However, any single inventive feature may not address all of the problems discussed above or only address one of the problems discussed above. Further, one or more of the problems discussed above may not be fully addressed by the features of each embodiment described below.

Figure 1A:
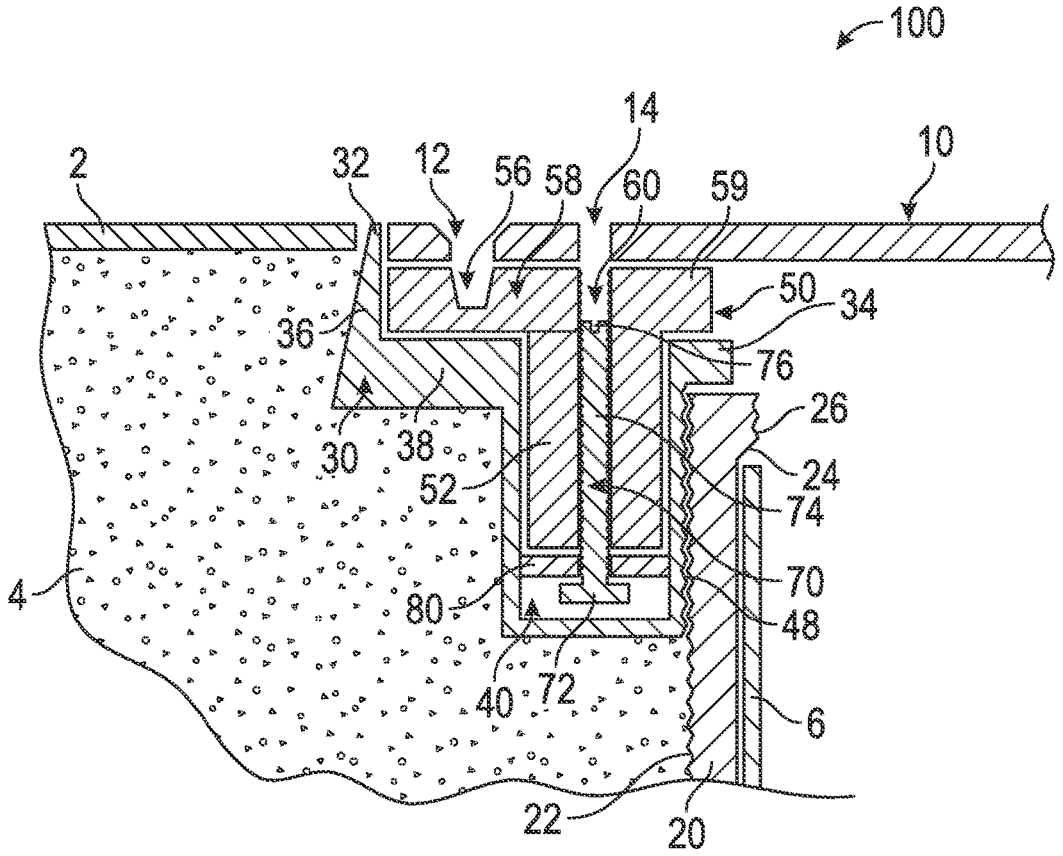
FIG. 1A illustrates one side of a cross section of one embodiment of an adjustable drain apparatus installed in a floor.
Figure 1B:
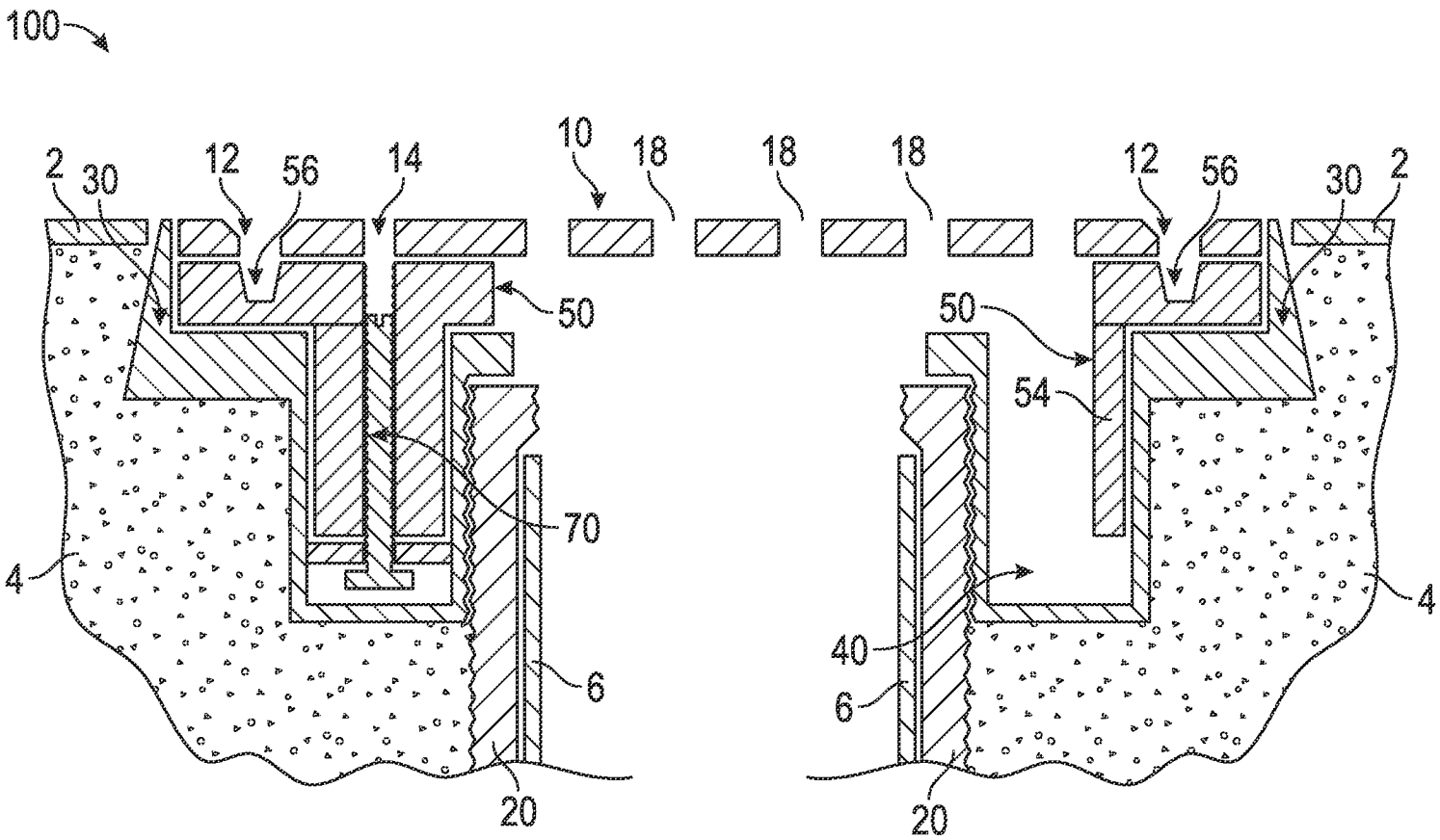
FIG. 1B illustrates a cross section of one embodiment of an adjustable drain apparatus installed in a floor.

FIG. 1A illustrates one embodiment of an adjustable floor drain assembly or apparatus 100. In some embodiments, the floor drain 100 can be a cylindrical structure configured to be positioned adjacent a drain pipe 6, such as surrounding the drain pipe 6. FIG. 1A illustrates one side of a cross section of the floor drain 100. FIG. 1B illustrates an entire cross section of one embodiment of a floor drain 100 positioned about a drain pipe 6. With reference to FIG. 1A, in some embodiments a floor drain apparatus 100 can include a cylindrical collar 20 that can be configured for positioning around the pipe 6. Preferably, the collar 20 can include a lip 24 that can be positioned about an end of the pipe 6. In some embodiments, the lip 24 can be angled, for example as illustrated, and in some embodiments the lip 24 can extend generally perpendicularly from the collar 20. In some embodiments, the collar 20 can have exterior threading 22 that can be configured to attach the collar 20 to other components of the drain 100.

In some embodiments, an interior of the collar 20 can be configured to receive a valve member. In some embodiments, the collar 20 can include internal threading 26 that can be used to attach the valve member to the collar 20.

In various embodiments, the adjustable drain apparatus 100 can include a cylindrical housing 30. In some embodiments, the housing 30 can include interior threads 48 that can be configured to mate with threading on the collar 20. In some embodiments, the housing can include an inner flange 34 that can be positioned over an upper end of the collar 20. As used herein, the terms "inner" and "outer" refer to radially inner and radially outer unless otherwise indicated. The inner flange 34 can help prevent screwing the housing 30 too far onto the collar 20. In some embodiments, a drain apparatus 100 may not include a collar 20, and the housing 30 can be positioned directly over the pipe 6, such as by having the flange 34 positioned over an end of the pipe 6.

A threaded relationship between the housing 30 and collar 20 can allow for adjusting the height of the housing 30 relative to the collar 20 and pipe 6. This adjustment is preferably done when installing the drain 100 in order to move the housing 30 to a desired height. For example, in some embodiments the housing 30 can be moved to a level approximately equal with the expected height of the floor. During installation, when the housing 30 has been placed at a desired height, concrete 4 can be placed to help provide a basis for the floor.

In some embodiments, the housing 30 can have an outer wall 36 that can extend to a top, or adjacent a top, of the adjustable drain apparatus 100. In some embodiments, the outer wall 36 can taper into an upper tip or edge 32. In some embodiments, the upper tip or edge 32 can be generally level with the surface of the floor 2. In some embodiments, once the housing 30 has been positioned relative to the pipe 6, concrete 4 can be placed to a height generally level with the tip or edge 32. In some embodiments, concrete can be poured to a height below the edge 32, such that a floor surface 2 placed above the concrete can be generally level with the tip or edge 32. In some embodiments, if the floor surface 2 is modified, not level, or otherwise varies from the height of the tip or edge 32, other components of the adjustable drain apparatus 100 can be moved to help level a grate 10 of the apparatus 100 with the floor 2.

In some embodiments, an adjustable drain apparatus 100 can include a leveling frame 50 that can be used to help adjust the height, angle, and/or other aspects of the grate 10. As used herein, references to adjusting the height of the grate 10 refer to adjustments that move a center of the grate 10 relative to a reference aspect of the adjustable drain apparatus 100 that does not move, such as the housing 30. Thus, angling the grate 10 about an axis that passes through the center of the grate 10 would not be considered an adjustment to the height of the grate 10, even though portions of the grate 10 may move up or down.

In some embodiments, the leveling frame 50 can be placed above the housing 30. In some embodiments, a portion of the leveling frame 50 can be positioned within a portion of the housing 30. For example, in some embodiments the housing 30 can include a channel 40 that can receive a portion of the leveling frame 50, such as a locking block 52. In some embodiments, the locking block 52 can include an internal flange 59 that can extend over a portion of the housing 30. This can help prevent fluid that enters the grate 10 from passing into the channel 40.

In some embodiments, the locking block 52 can include an actuation aperture 60 that can be configured to receive a leveling member 70, such as a leveling screw. In some embodiments, adjusting the leveling member 70 can adjust the position of the locking block 52 relative to the housing 30. In some embodiments, for example as illustrated, the leveling member 70 can also be used to attach the leveling frame 50 to the housing 30. This dual functionality of the leveling member 70 can remove the need for separate structures, such as screws, to attach the leveling frame 50 to the housing 30. Additionally, it can allow for adjusting the position of the locking block 52 relative to the housing 30 while the frame 50 remains rigidly attached to the housing 30. In other words, the leveling member 70 can secure the frame 50 to the housing 30 such that the only possible movement of the housing 30 relative to the locking block 52 and frame 50 is through actuating the leveling member 70.

In some embodiments, the leveling member 70 can include a shaft 74 and a head 72. The shaft 74 can include external threading that is configured to engage threading of the actuation aperture 60. The housing 30 can include a plate 80 or other blocking structure that can have an opening wide enough to allow the shaft 74 to pass through the opening but narrow enough to block the head 72 from passing through the opening. Thus, the plate 80 can help block movement of the leveling member 70 relative to the housing 30 such that the leveling member 70 can remain fixed relative to the housing 30. Consequently, when the leveling member 70 is positioned as illustrated in FIG. 1A, rotating the leveling member 70 can move the leveling frame 50 at the position of the leveling member 70 up or down relative to the housing 30, depending on the direction of rotation of the leveling member 70.

In some embodiments, the leveling member 70 can include a tool receiving portion 76 at a top end of the leveling member 70, which can be used to rotate the leveling member 70. In some embodiments, the tool receiving portion 76 can be a hexagonal socket, such that it can receive a hex key (e.g., an Allen wrench). Other configurations of the tool receiving portion 76 are considered, such that a variety of types of tools can be used to actuate the leveling member 70. For example, the tool receiving portion 76 can be configured as a slot to receive a flat head screw driver, as a cross-shape to receive a Philips head screw driver, etc. In some embodiments, a grate 10 positioned above the leveling frame 50 can include an opening 14 that can allow the tool to pass through the grate 10 and into the actuation aperture 60.

In various embodiments, a leveling frame 50 can include a plurality of locking blocks 52, each of which can correspond to a leveling member 70. If the leveling member 70 for each locking block 52 is adjusted the same amount, the height of the leveling frame 50 and grate 10 can increase or decrease accordingly. In contrast, actuating fewer than all of the leveling members 70, or actuating them different amounts or in different directions, will angle the leveling frame 50 and grate 10 by raising or lowering the side of the leveling frame 50 and the side of the grate 10 corresponding to each leveling member 70. Preferably, a leveling frame 50 includes at least three locking blocks 52, such that by adjusting the leveling members 70 a different amount at each locking block the plate 10 can be configured to reach any desired height in any desired angle within an available range.

Figure 8A:
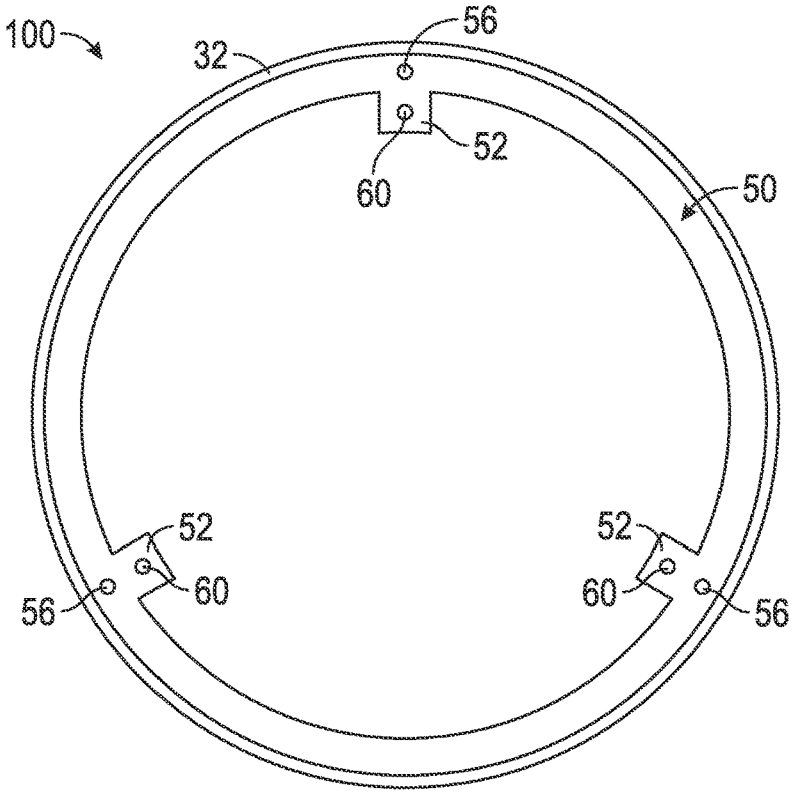
FIG. 8A is a top view of one embodiment of an adjustable drain apparatus, with a grate not shown.

In some embodiments, for example as shown in FIG. 8A, a leveling frame 50 can include three locking blocks 52 positioned evenly around a circumference of the leveling frame 50. In such embodiments, a cross section of an adjustable drain apparatus 100 may show a portion of the leveling frame 50 that includes a locking block 52 on one side of the drain pipe 6 and a portion of the leveling frame 50 without a locking block 52 on another side of the drain pipe 6. This is shown, for example, in FIG. 1B. In some embodiments, the locking blocks 52 may be directly across from each other, for example in embodiments of the leveling frame 50 having two or four locking blocks 52. In some embodiments, a portion of the leveling frame without a locking block 52 may include a fin 54 that extends into the housing channel 40.

With further reference to FIGS. 1A and 1B, in some embodiments a grate 10 can include an attachment opening 12 that can be configured to align with an attachment screw hole 56 in the leveling frame 50. The leveling frame 50 can include an outer ring or flange 58 with the attachment hole 56, which can be used to secure the leveling frame 50 to the grate 10. The outer ring or flange 58 can be integral with another feature or features of the leveling frame 50, for example integral with the locking block 52. In some embodiments, the hole 56 can be threaded and can be configured to receive a screw. In some embodiments, the attachment opening 12 can also be threaded to receive a screw. In some embodiments, the attachment opening 12 is not threaded. A screw or other locking mechanism can be inserted through these aligned holes and can be used to attach the grate 10 to the leveling frame 50. In some embodiments, the attachment opening 12 can have a counter bore, such as illustrated, thereby allowing a screw head to be flush with an upper surface of the grate 10. In some embodiments, for example as illustrated in FIG. 1B, the grate 10 can include a plurality of grate openings 18, which can be sized as desired to allow fluid to pass through the grate 10 and into the drain pipe 6 but prevent larger objects from passing through and into the drain pipe 6. In some embodiments, the grate 10 can include a plurality of the attachment openings 12 and/or screw holes 56. As shown in FIG. 1B for example, the plurality of attachment openings 12 and/or screw holes 56 may be located directly across from each other, such as 180 angular degrees apart. In some embodiments, the plurality of attachment openings 12 and/or screw holes 56 may not be located directly across from each other. For example, the plurality of attachment openings 12 and/or screw holes 56 may be located angularly approximately 60 degrees from each other, as shown and further described herein, for example with respect to FIG. 8A.

Figure 2:
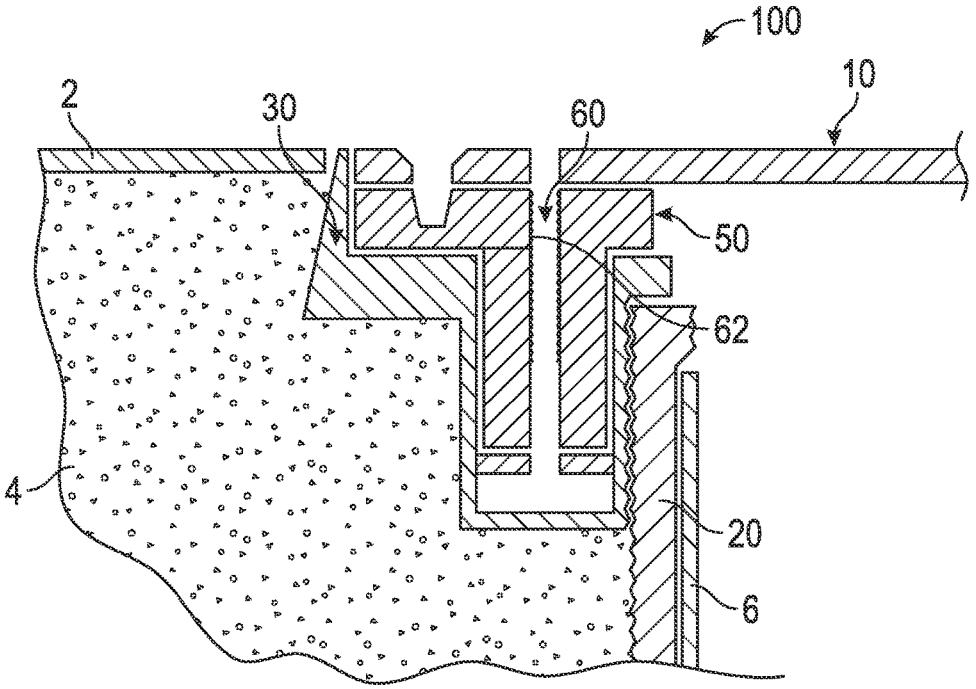
FIG. 2 illustrates one side of a cross section of one embodiment of an adjustable drain apparatus installed in a floor, with a leveling member not shown.

FIG. 2 illustrates a cross-section of FIG. 1A but with the leveling member 70 removed. FIG. 2 illustrates an example of one embodiment in which the threading 62 in the actuation aperture 60 does not extend to a bottom end of the actuation aperture 60. This can assist when assembling the adjustable drain apparatus 100, because it can help allow a leveling member 70 to be inserted into and aligned with the actuation aperture 60 before needing to engage the leveling member 70 with the thread 62. In some embodiments, at least the bottom ⅛ (one eighth) inch of the actuation aperture 60 can be without threads 62. In some embodiments, at least the bottom ¼ (one quarter) inch of the actuation aperture 60 can be without threads 62. In some embodiments, at least the bottom ½ (one half) inch of the actuation aperture 60 can be without threads 62.

Figure 3:
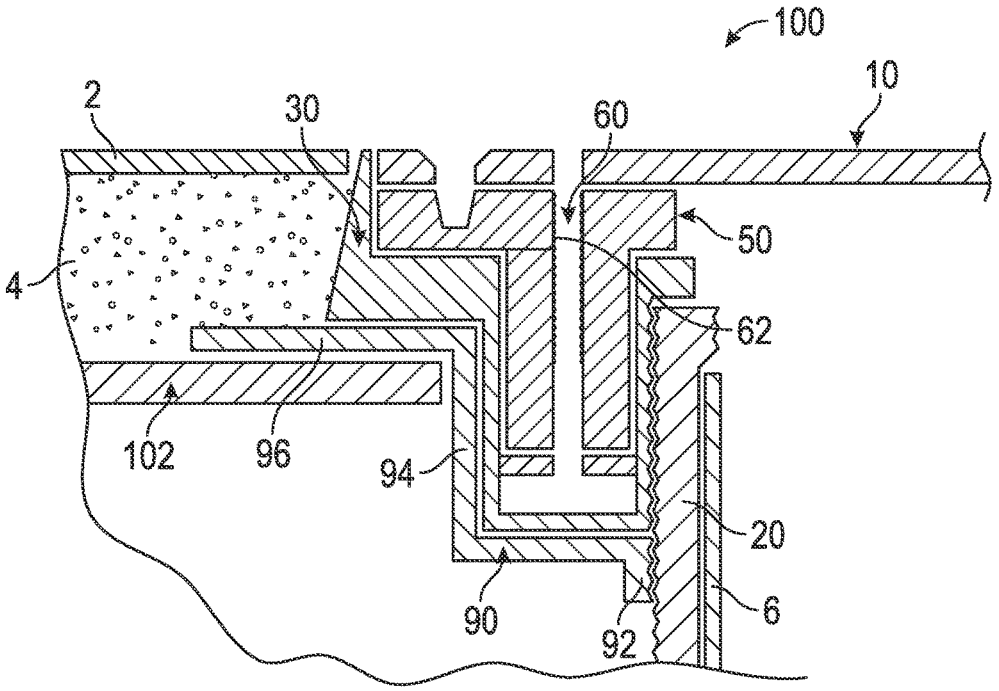
FIG. 3 illustrates one side of a cross section of one embodiment of an adjustable drain apparatus installed in a floor with a base floor.

In some embodiments, where a base floor 102, such as a wood or corrugated floor, is in place, an adjustable drain apparatus 100 can include components that can help set the drain apparatus 100 relative to the base floor 102. For example, with reference to FIG. 3, in some embodiments the adjustable drain apparatus 100 can include an outer collar 90 that can attach to the collar 20. The outer collar 90 can include a threaded attaching portion 92 that can engage exterior threads on the collar 20. In some embodiments, the outer collar 90 can also include a wall 94 and an outer flange 96 that can extend onto the base floor 102. In some embodiments, concrete 4 and/or flooring 2 can then be positioned above the base floor 102, such as described above.

Figure 4A:
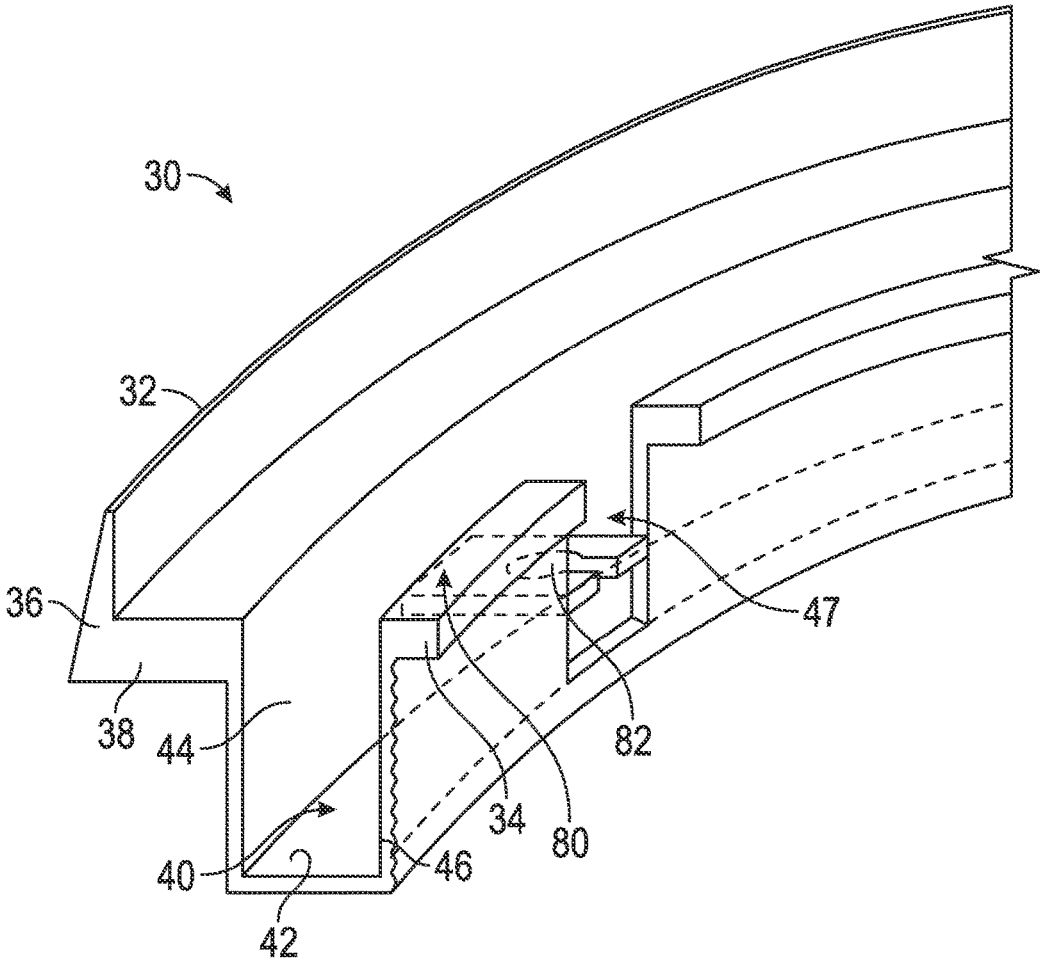
FIG. 4A illustrates a section of a perspective view of one embodiment of a housing.

FIG. 4A illustrates a cutaway perspective view of a portion of a generally cylindrical outer housing 30 that can be used with the drain apparatus 100. As shown for example in FIG. 4A, in some embodiments the housing 30 can include a housing channel 40, an outer wall 44, an inner wall 46, and a base or bottom 42. In some embodiments, the channel 40 can extend around an entire circumference of the housing 30. In some embodiments, the housing 30 can include multiple channels 40, each of which extends around only a portion of a circumference of the housing 30.

FIG. 4A also illustrates one embodiment of a plate 80 that can be used to lock the position of a leveling member 70 relative to the housing 30, for example as described above by using the plate 80 or other blocking structure. The plate 80 is shown in FIG. 4A mostly as dotted lines because in the view shown and as oriented the plate 80 is mostly behind other features of the housing 30. As used herein, references to locking, blocked, fixing, etc. the position of the leveling member 70 relative to the housing 30 refer to translational position. It is understood that in some embodiments the leveling member 70 may rotate relative to the housing 30.

Figure 4B:
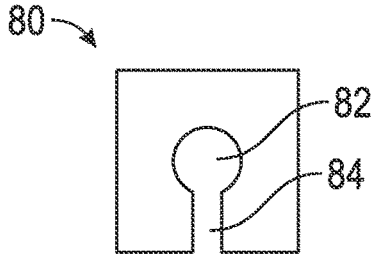
FIG. 4B illustrates a top view of one embodiment of a plate.

FIG. 4B illustrates a top view of one embodiment of a plate 80 that can be used with the drain apparatus 100. The plate can include a hole 82 through which a portion of the leveling member 70, such as the shaft of the leveling member 70, can pass. In some embodiments, the plate 80 can also include a connecting cutout or channel 84 that joins the hole 82 with an exterior surface of the plate 80. The connecting channel 84 can be used to allow the leveling member 70 to be positioned through the hole 82. For example, when installing an adjustable drain apparatus, the leveling member 70 can be inserted through an opening 47 in the inner wall 46 that is preferably aligned with the plate 80. The leveling member 70 can be inserted through the channel 84 until a head, such as the head 72, of the leveling member 70 is below the plate 80 and a shaft, such as the shaft 74, of the leveling member 70 extends through the hole 82. Each leveling member 70 of the adjustable drain apparatus 100 can be positioned accordingly, and the frame 50 can be inserted into position with the leveling members extending into a corresponding actuation aperture 60 of a locking block 52. The leveling members 70 can then be actuated to move the frame 50 and locking blocks 52 into or further into the channel 40.

Figure 4C:
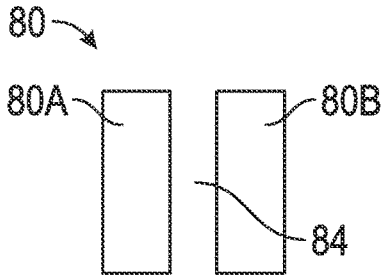
FIG. 4C illustrates a top view of one embodiment of a plate.

Instead of a single structure, in some embodiments two separate blocking structures can be used to block the head 72 of a leveling member 70. For example, FIG. 4C illustrates an embodiment of a locking plate 80 that includes a first member 80A and a second member 80B with a cutout or channel 84 that extends between the entirety of both the first and second members 80A, 80B. The channel 84 is preferably wide enough to allow the shaft 74 of a leveling member 70 to pass, but narrow enough to block the head 72 of the leveling member 70.

The plate 80 is preferably offset from the bottom 42 of the channel 40 to provide room for a head 72 of a leveling member 70. In some embodiments, the plate 80 can be positioned a distance above the bottom 42 that is approximately equal to the thickness of a head 72 of a leveling member 70. In some embodiments, plate 80 can be positioned a distance greater than the thickness of the head 72 above the bottom 42. The plate 80 can be attached to the housing 30, such as at the outer wall 44 and/or at a side wall of the opening 47, through a variety of aspects known in the art, such as through welding, gluing, or other attachment methods. The housing 30, including the plate 80, can be made of a variety of materials. In some embodiments, the plate 80 and/or other parts of the housing 30 can be formed of plastic, polymer, composites, other materials, or combinations thereof. In some embodiments, the plate 80 can be metal. In some embodiments, the entire housing 30 can be metal.

Figure 5:
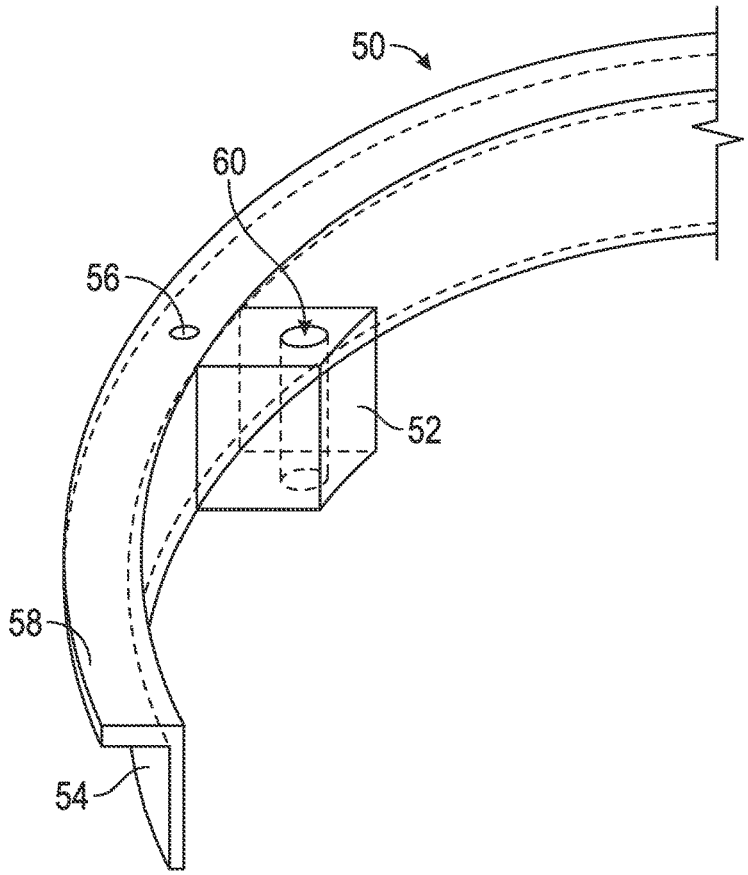
FIG. 5 illustrates a section of a perspective view of one embodiment of a leveling frame.

FIG. 5 illustrates a section of a perspective view of the leveling frame 50. As shown by example in FIG. 5, the leveling frame 50 can include one or more locking blocks 52 that extend inward from a fin 54 of the leveling frame 50. Preferably, the leveling frame 50 forms a complete circle and has three locking blocks 52 spaced equally around its circumference. The locking blocks 52 can include an actuation aperture 60, which can receive a leveling member 70 as discussed above. The leveling frame 50 can include an outer ring or flange 58 with one or more attachment holes 56, which can be used to secure the leveling frame 50 to a grate, such as the grate 10 described herein.

FIG. 5 does not illustrate the flange 59 shown in FIG. 1A, although it is understood that in various embodiments the leveling frame 50 can include an inner flange 59 associated with each locking block 52, or an inner flange 59 that extends circumferentially around the entire leveling frame 50. In some embodiments, the leveling frame 50 may not have any inner flange.

In some embodiments, the fin 54 can extend around an entire circumference of the leveling frame 50. The fin 54 can help prevent any fluid that enters between the housing 30 and the leveling frame 50 (such as concrete, grout, or other fluids or semi-solids) from entering the drain pipe 6. Any such fluid would need to pass all the way below the fin 54 and then rise above the top of the channel 40. In some embodiments, the portions of the fin 54 not aligned with locking plates 80 can extend to the bottom surface 42 of the channel 40.

Figure 6:
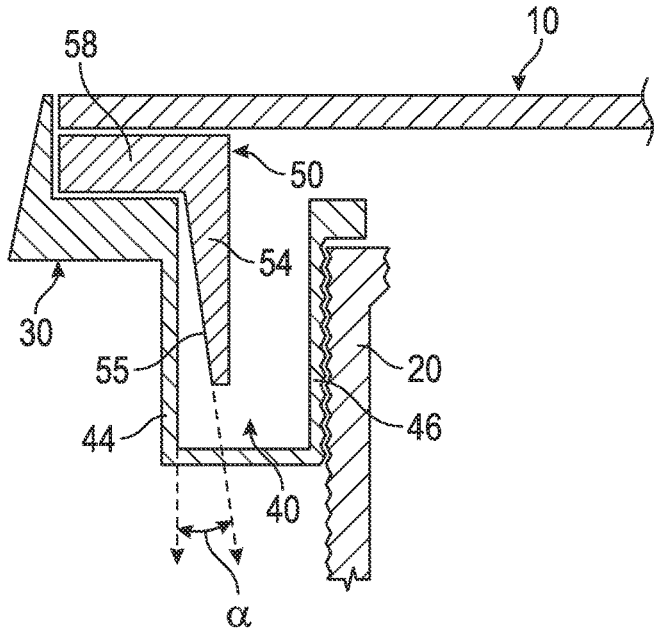
FIG. 6 illustrates a cross section of one embodiment of an adjustable drain apparatus with an angled fin.

In some embodiments, to help allow the leveling frame 50 to angle relative to the housing 30 and prevent it from binding, it can be desirable for the fin 54 of the leveling frame 50 to have an angle. FIG. 6 illustrates an example of one embodiment in which an outer wall 55 of the fin 54 is angled relative to an outer wall 44 of the housing 30. In some embodiments, the resulting angle $\alpha$ can be between 0 degrees and 15 degrees. In some embodiments, the angle $\alpha$ can be between 2 degrees and 12 degrees. In some embodiments, the angle $\alpha$ can be between 3 degrees and 10 degrees. In some embodiments, the angle $\alpha$ can be between 4 degrees and 8 degrees. In some embodiments, the fin 54 can be angled in the opposite direction, such that a bottom end of the fin can be closer to the outer wall 44 than a top end of the fin. In some embodiments, rather than or in addition to angling the fin 54, the channel 40 can be sized such that there is a gap between the outer wall 44 and the fin 54.

Figure 7:
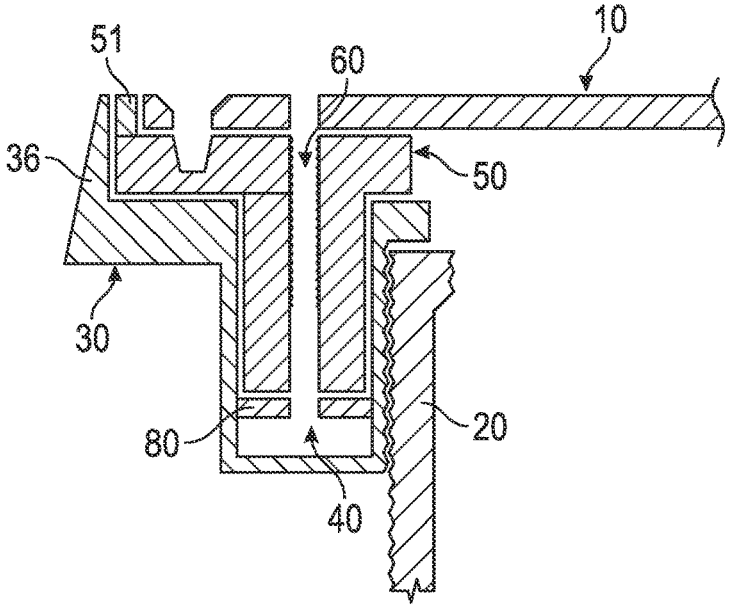
FIG. 7 illustrates a cross section of one embodiment of an adjustable drain apparatus having a leveling frame with an upper ring.

In some embodiments the leveling frame 50 can have a portion that extends past a bottom surface of the grate 10. For example, as illustrated in FIG. 7, in some embodiments the leveling frame 50 can have an upper ring 51 that extends upward between the grate 10 and the outer wall 36 of the housing 30. In some embodiments, the upper ring can be flush with a top surface of the grate 10. In some embodiments, the upper ring 51 can be formed of a material different from the rest of the leveling frame 50. For example, in some embodiments, the upper ring 51 can be metal and the rest of the leveling frame can be plastic. In some embodiments, the upper ring 51 can be provided as a metal ring and the remainder of the leveling frame 50 can be injection molded onto the bottom of the ring 51 in order to form the leveling frame 50. In some embodiments, the upper ring 51 can be integral with another feature or features of the leveling frame 50. The upper ring 51 can help when positioning the grate 10 over the leveling frame 50. The upper ring 51 can also allow materials, for example concrete and/or grout, to be placed tightly against the ring 51 while still allowing the grate 10 to be easily removed.

Figure 8B:
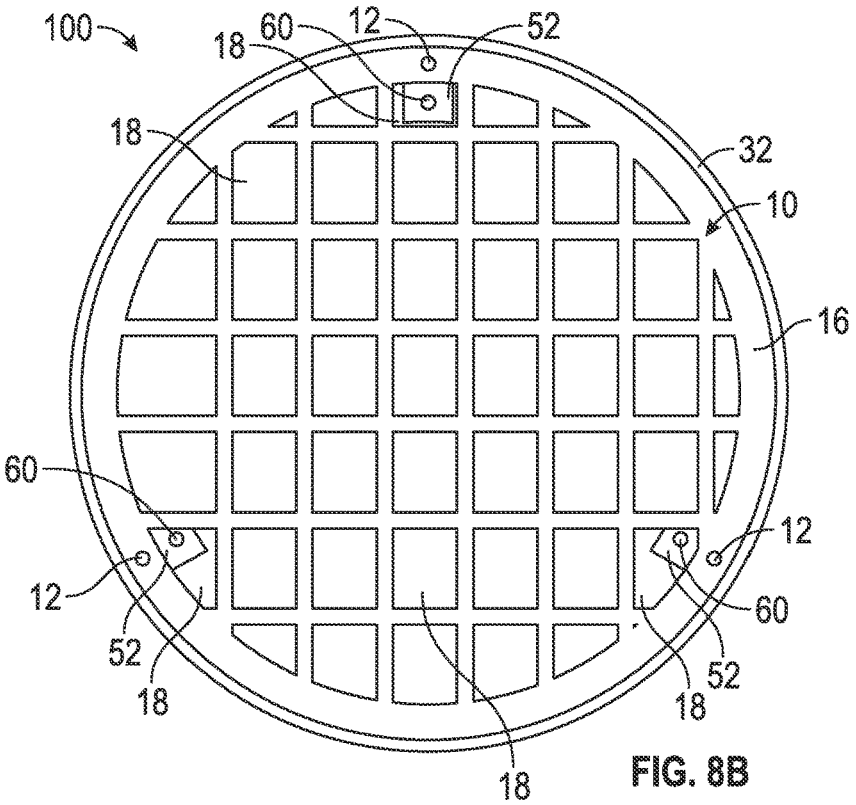
FIG. 8B is a top view of the adjustable drain apparatus of FIG. 8A with a grate shown.

FIG. 8A illustrates a top view of one embodiment on an adjustable drain apparatus 100 without a grate. The apparatus 100 is preferably cylindrical or generally cylindrical, for example as illustrated. The tip 32 of the outer wall of the housing, such as the housing 30 described herein, is drawn with a width, but in some embodiments the tip 32 can be just an edge that surrounds a portion of the leveling frame 50. FIG. 8B illustrates an embodiment of the adjustable drain apparatus 100 with the grate 10 attached. As shown in FIG. 8B, the attachment openings 12 can be used to attach the grate 10 to the frame 50. Preferably, the actuation aperture 60 is accessible through the grate 10. This allows for adjusting the height and/or angle of the leveling frame 50 and grate 10 without having to remove the grate 10. In some embodiments, for example as illustrated, the actuation aperture 60 can be accessed through grate openings 18. In some embodiments, an outer rim 16 of the grate can be thicker and can extend over the actuation aperture 60. In such embodiments, the outer rim 16 can include actuation openings 14 (such as illustrated in FIG. 1A) that can be aligned with actuation apertures 60.

Figure 9:
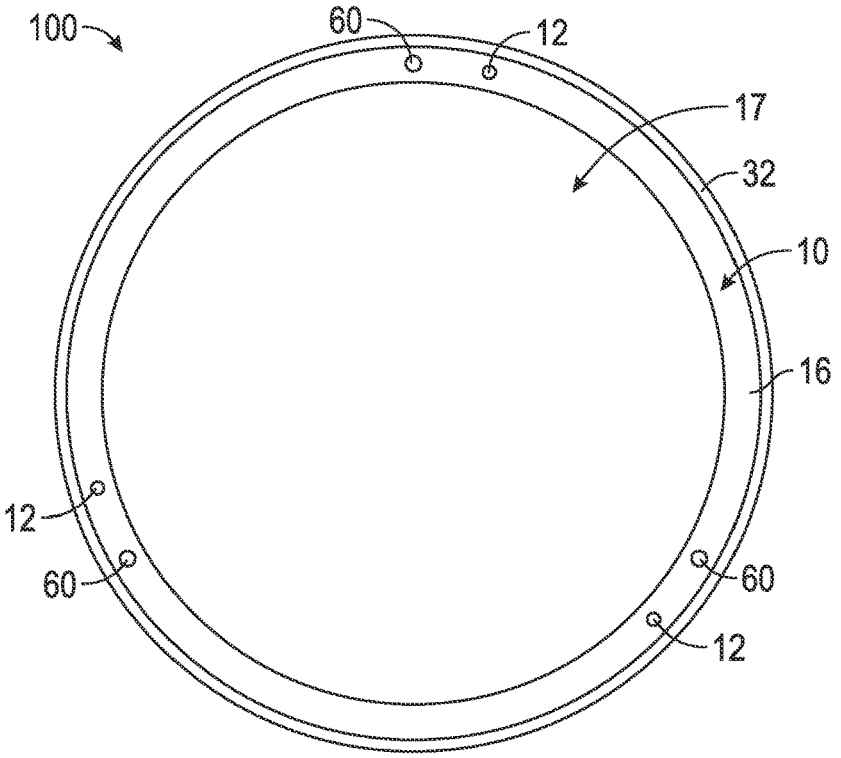
FIG. 9 is a top view of one embodiment of an adjustable drain apparatus.

In some embodiments, for example as shown in FIG. 9, an adjustable drain apparatus 100 can be configured with the actuation apertures 60 and the attachment openings 12 both positioned about the same distance from the center of a grate (e.g., in a shared circumference of the grate). Further examples are illustrated and described in more detail below. Having the actuation apertures 60 and attachment openings 12 a similar distance from the center of the grate can make it possible to include both the apertures 60 and the openings 12 within a narrower outer rim 16, thereby allowing for more space on the grate 10 that can permit fluid to flow through. FIG. 9 does not illustrate grate openings 18, but it is understood that a central portion 17 of the grate 10 can include grate openings of varying designs, including for example the designs shown in FIG. 8B. Further, any of the embodiments of the drain apparatus 100 and/or grate 10 as shown in FIGS. 8A-9 may be included in or with the other embodiments of the drain assembly disclosed herein, for example with the grate 10 and/or the leveling frame 50 depicted and described with respect to FIG. 3.

Figure 10:
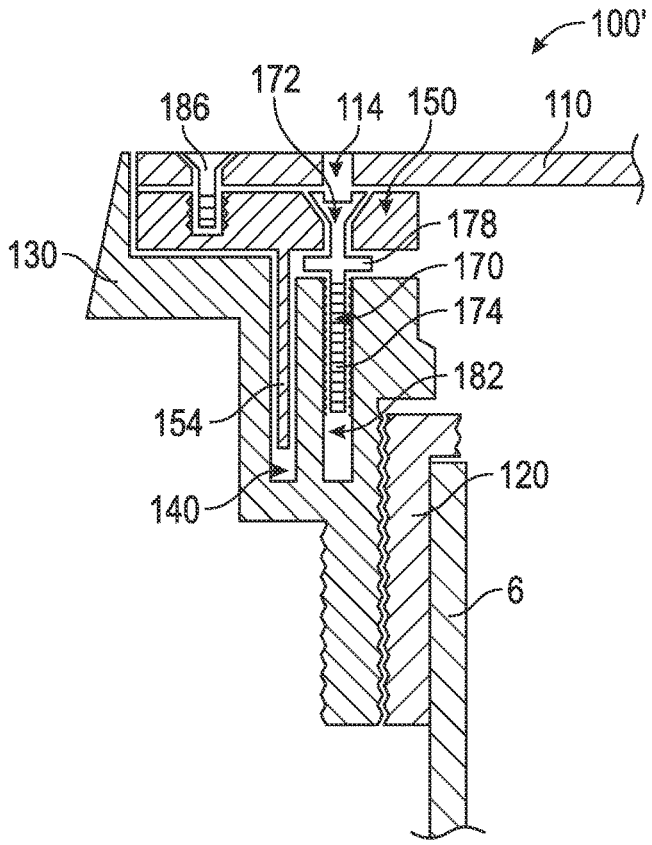
FIG. 10 illustrates a cross section of an alternate embodiment of an adjustable drain apparatus.
Figure 11:
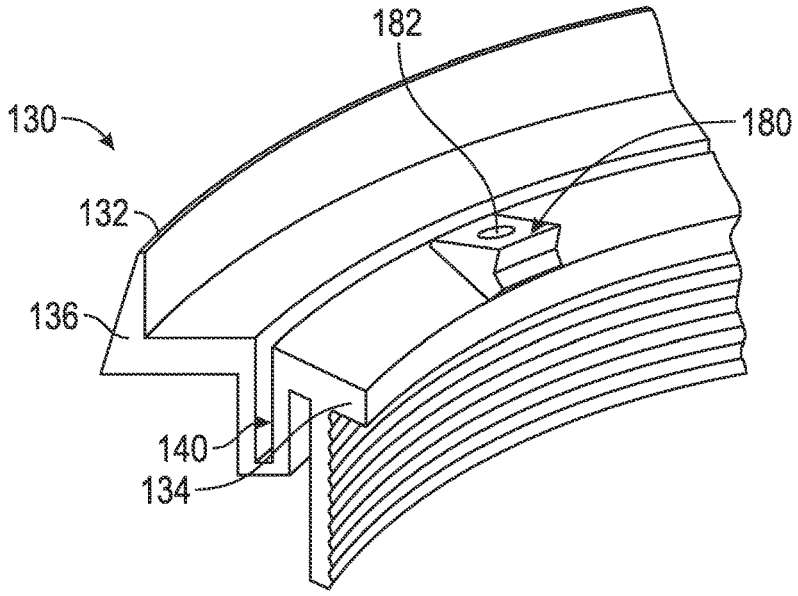
FIG. 11 illustrates a section of a perspective view of one embodiment of a housing.
Figure 12:
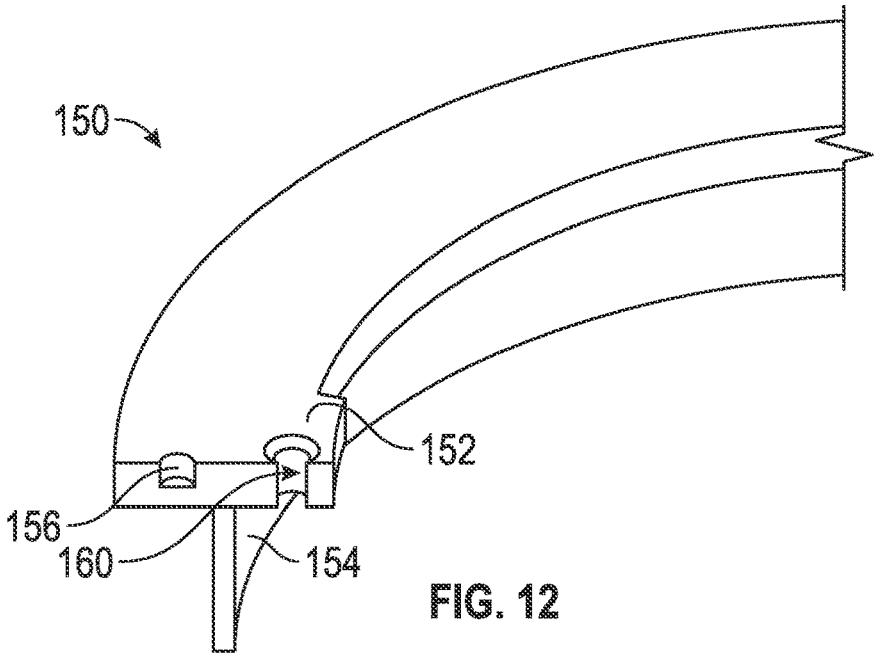
FIG. 12 illustrates a section of a perspective view of one embodiment of a leveling frame.

FIGS. 10-12 illustrate an alternate embodiment of an adjustable drain apparatus 100' that can be used to adjust the height and/or angle of a grate 110. In some embodiments, the adjustable drain apparatus 100' can be adjusted without needing to remove the grate 110 from a leveling frame 150.

FIG. 10 illustrates a cross-section of a portion of the adjustable drain apparatus 100'. The apparatus 100' can be positioned relative to a drain pipe 6 and floor as described above. Further, it is understood that elements labeled with numbers similar to those from previous embodiments may operate in a manner similar to that described above unless otherwise mentioned. Thus, for example, the adjustable apparatus 100' can include a housing 130 with a channel 140 that can receive a fin 154 of a leveling frame 150.

In contrast to prior embodiments, however, when adjusting the leveling frame 150, the leveling member 170 can move relative to the housing 130. The leveling member 170 can include a threaded shaft 174 that can be inserted into and engage threading within a locking hole 182 of the housing. The leveling member can include a flange 178 between the housing 130 and the leveling frame 150 that can be used to engage and move the leveling frame 150 when the leveling member 170 is screwed in a direction that raises the leveling member 170 relative to the housing 130.

The leveling member 170 can also include a head 172 that can be wider than a shaft 174 of the leveling member 170. The head 172 can interact with the leveling frame 150 to help lock the leveling frame 150 relative to the housing 130. Thus, the leveling member 170 can serve to both adjust the height and/or angle of the leveling frame 150 and secure the leveling frame 150 to the housing 130. FIG. 10 also illustrates a locking screw 186 that can be used to lock the grate 110 to the leveling frame 150. Similar locking screws can be used in other embodiments described herein to lock grates to leveling frames.

FIG. 11 illustrates a section of a perspective view of a housing 130 that can be used with the drain apparatus 100'. The housing can include a locking structure 180 that can include a locking hole 182 to receive a leveling member 170. The housing 130 can have a plurality of locking structures 180 positioned about the circumference of the housing. In some embodiments, such as described above with respect to the housing 30, the housing 130 can include three locking structures positioned generally equidistant around the circumference, or more or fewer locking structures in other positions.

FIG. 12 illustrates a section of a perspective view of a leveling frame 150 that can be used with the drain apparatus 100'. In some embodiments, for example as illustrated, the leveling frame 150 can include an attachment screw hole 156 and an actuation aperture 160 that can receive a portion of a leveling member 170. In some embodiments, the leveling frame 150 can have a flanged section or flange 152 through which the actuation aperture 160 extends. In some embodiments, the leveling frame 150 can have a flanged section 152 and actuation aperture 160 that correspond to each locking structure 180 of the housing 130.

In some embodiments, the actuation aperture 160 can extend laterally to form an opening in a wall (e.g., an inner wall) of the flange 152. This can allow a leveling member 170 to slide horizontally or otherwise sideways into position within the aperture 160, similar to how a leveling member 70 can be positioned within the hole 82 of the plate 80 of FIG. 4A. When assembling an adjustable drain apparatus 100', the leveling member 170 can be positioned within the actuation aperture 160 and then the leveling frame 150 with leveling member 170 can be positioned on the housing 130. The leveling member 170 can then be actuated to move it into the locking hole 182, such as by screwing the leveling member 170 into the locking hole 182.

Figure 13:
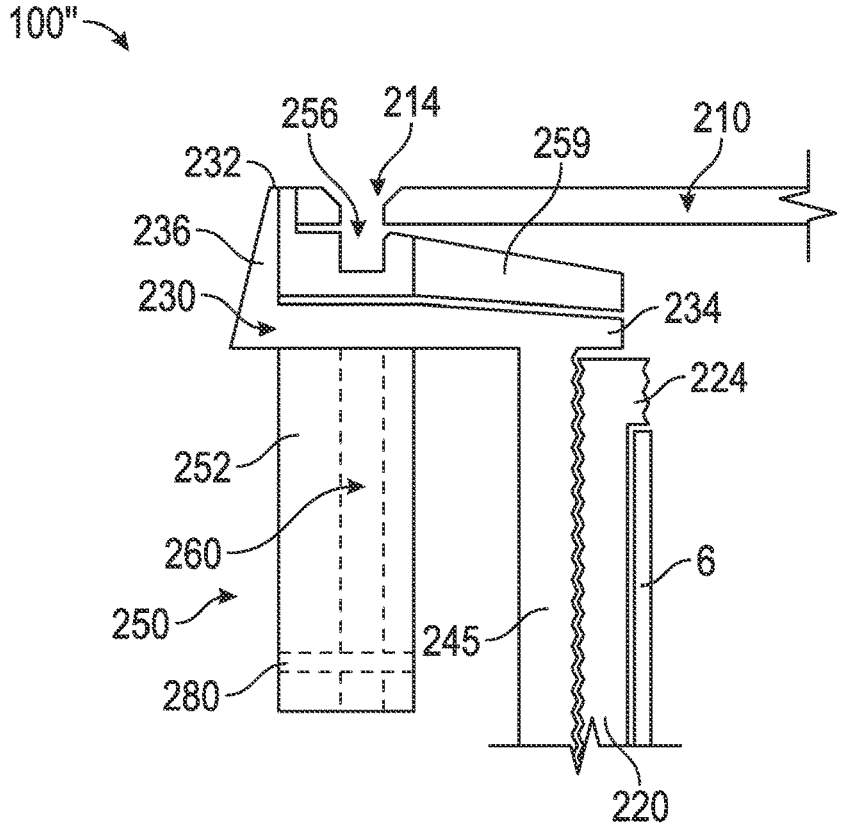
FIG. 13 illustrates a cross section of an alternate embodiment of an adjustable drain apparatus.
Figure 14:
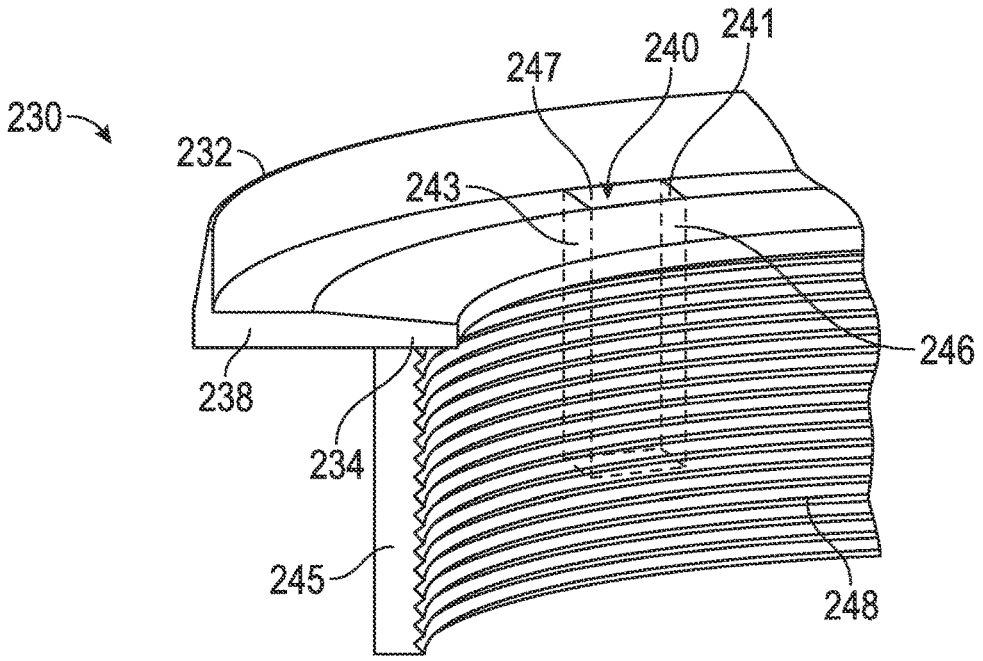
FIG. 14 illustrates a section of a perspective view of one embodiment of a housing.
Figure 15:
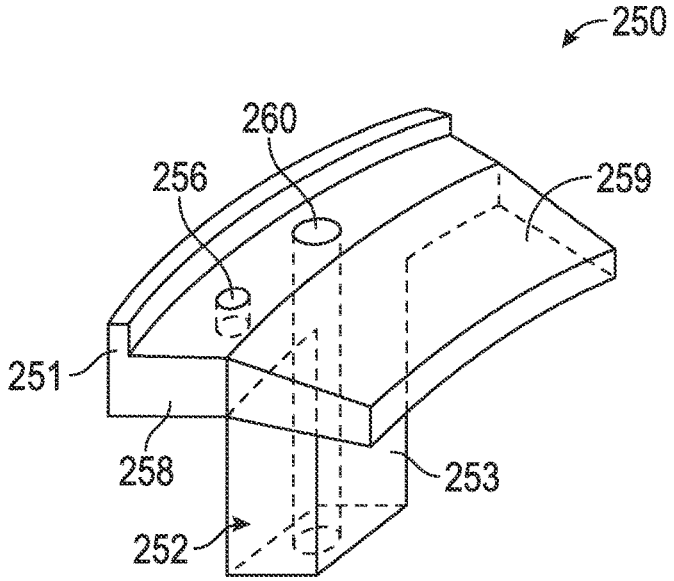
FIG. 15 illustrates a section of a perspective view of one embodiment of a leveling frame.

FIGS. 13-15 illustrate an alternate embodiment of an adjustable drain apparatus 100" that can be used to adjust the height and/or angle of a grate 210. In some embodiments, the drain apparatus 100" can be adjusted without needing to remove the grate 210 from a leveling frame 250. FIG. 13 illustrates a cross-section of a portion of the adjustable drain apparatus 100". The apparatus 100" can be positioned relative to a drain pipe 6 and floor as described above. Further, it is understood that elements labeled with numbers similar to those from previous embodiments may operate in a manner similar to that described above unless otherwise mentioned. Thus, for example, the adjustable apparatus 100" can include a housing 230, a collar 220, and a leveling frame 250. Similarly, the leveling frame can include a locking block 252 with an actuation aperture 260 that can receive a leveling member. Also as above, a plate 280 can interfere with a head of the leveling member to retain the leveling member in position relative to the housing 230. In various embodiments the plate 280 can have a variety of configurations, including those described herein, such as the plates 280 illustrated in FIGS. 4B and 4C.

FIG. 14 illustrates a portion of a perspective view of the housing 230 that can be used with the apparatus 100". In some embodiments, for example as illustrated, rather than having a single circumferential channel, the housing 230 can include one or more channels or shafts 240 that can be configured to receive locking blocks 252 of the locking frame 250. This can help limit required materials for fabricating the device. In some embodiments, the housing 230 can have a plurality of shafts 240 with each shaft 240 corresponding to a respective one of a plurality of locking blocks. In some embodiments, the housing 230 can have three shafts 240 positioned equidistant about the circumference of the housing. In some embodiments, the housing can have more than three shafts and/or at various locations relative to each other.

In some embodiments, the shaft 240 can be defined by a first side wall 243, a second side wall 241, and an inner side wall 246. In some embodiments, the shaft can have an opening 247 on its outer side (e.g., have an opening in an outer wall or have no outer wall) that can allow a leveling member to be positioned within the shaft 240 with a head of the leveling member below a plate and a shaft of the leveling member extending above the plate (for clarity, the plate is not illustrated in FIG. 14 but it can be seen in FIG. 13). Once a leveling member has been positioned in each shaft 240, the leveling frame 250 can be positioned on the housing 230.

In some embodiments, the housing 230 can include a housing collar 245 that engages the collar 220 (shown in FIG. 13). In some embodiments, this engagement can be with interior threading 248 of the housing collar 245. In some embodiments, the housing collar 245 can be separated by a gap from an inner wall 246 of the shaft 240 (the gap is most easily visible in FIG. 13). In some embodiments, struts, braces, or other structures can be used to connect the shaft 240 and the housing collar 245 to help support the shaft 240.

FIG. 15 illustrates a section of a perspective view of the leveling frame 250 that can be used with the apparatus 100". The leveling frame 250 can include an actuation aperture 260 and an attachment screw hole 256 that can be used to attach the leveling frame 250 to a grate. In some embodiments, rather than having the actuation aperture 260 and screw hole 256 aligned radially, they can be aligned circumferentially, for example as illustrated. The frame 250 can thus be used with a grate 10 such as that described with respect to FIG. 9, which can provide a greater area through which fluid can flow.

In some embodiments, the leveling frame 250 can include an inner flange 259. The inner flange can be configured to align with the housing, for example as shown in FIG. 13. This can help prevent water that flows through the grate 210 from flowing into the shaft 240 of the housing 230. In some embodiments, the flange 259 can extend around an entire circumference of the leveling frame 250. In some embodiments, the leveling frame 250 can include a flange 259 associated with each locking block 252. In some such embodiments, each flange 259 can have the same circumferential width as its corresponding locking block 252. In some embodiments, each flange 259 can be wider than its corresponding locking block 252, for example as illustrated.

In some embodiments, each locking block 252 can be sized such that it maintains a relatively flush fit within a corresponding shaft 240. In some embodiments, the shafts 240 can be larger than the locking blocks 252. This can allow some play, for example angling and/or other movements, of the locking blocks 252 within the shafts, which can prevent binding when leveling members are actuated in such a way as to angle the leveling frame 250.

The terms "approximately", "about", and "substantially" as used herein represent an amount or characteristic close to the stated amount or characteristic that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount or characteristic.

Although the foregoing description of the preferred embodiments has shown, described and pointed out the fundamental novel features of the inventions, it will be understood that various omissions, substitutions, and changes in the form of the detail of the apparatus as illustrated as well as the uses thereof, may be made by those skilled in the art, without departing from the spirit of the inventions.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. An adjustable floor drain apparatus, the adjustable floor drain apparatus comprising:

a cylindrical collar comprising a threaded surface and configured to be positioned at least partially around a drain pipe;

a cylindrical housing comprising a threaded surface configured to engage the threaded surface of the collar, the housing further comprising a plurality of receiving shafts, each receiving shaft having a bottom and an open top;

a plurality of plates, each plate positioned within one of the plurality of receiving shafts and offset from the bottom of the shaft, each plate comprising a channel;

a leveling frame comprising a ring and a plurality of locking blocks extending below the ring, each of the plurality of locking blocks configured to be positioned within a corresponding receiving shaft of the housing and comprising a threaded vertical bore;

a plurality of leveling members, each of the leveling members comprising a head at a first end and a threaded shaft with a tool receiving portion at a second end, each of the plurality of leveling members configured to be positioned in a respective receiving shaft of the plurality of receiving shafts with the head at least partially between a respective plate of the plurality of plates and the bottom of the respective receiving shaft, and with the shaft threadably engaged within the threaded vertical bore of the locking block positioned within the respective receiving shaft; and a grate securable to the frame, the grate comprising a plurality of openings, each of the plurality of openings configured to be aligned with the threaded bore of a respective one of the plurality of locking blocks.

2. The adjustable floor drain apparatus of claim 1, wherein the leveling frame further comprises a plurality of threaded attachment holes and the grate further comprises a plurality of attachment openings, each of the attachment openings configured to be aligned with one of the threaded attachment holes to thereby receive a screw and secure the grate to the leveling frame.

3. The adjustable floor drain apparatus of claim 1, wherein the plurality of receiving shafts is three receiving shafts.

4. The adjustable floor drain apparatus of claim 1, wherein the leveling frame comprises a plurality of inward extending flanges, each flange configured to be aligned with a respective receiving shaft of the plurality of receiving shafts.

5. An adjustable floor drain apparatus, the adjustable floor drain apparatus comprising:

a housing configured for positioning adjacent a drain pipe;

a leveling frame configured to be positioned at least partially above the housing;

a grate configured to be positioned at least partially above the leveling frame and secured to the leveling frame; and a leveling member, wherein the leveling member is configurable such that actuating the leveling member adjusts the position of the grate relative to the housing while the leveling member remains axially fixed relative to the housing.

6. The adjustable floor drain apparatus of claim 5, wherein the leveling member is accessible to be actuated while the grate is secured to the leveling frame.

7. The adjustable floor drain apparatus of claim 5, further comprising a collar between the housing and the drain pipe.

8. The adjustable floor drain apparatus of claim 5, wherein the housing comprises a channel and the leveling frame comprises a projection configured to be positioned within the channel.

9. The adjustable floor drain apparatus of claim 5, wherein the grate is configured to be secured directly to the leveling frame.

10. The adjustable floor drain apparatus of claim 5, wherein the leveling member is configured to connect the leveling frame to the housing.

11. The adjustable floor drain apparatus of claim 5, wherein the leveling member is a first leveling member, and further comprising a second leveling member and a third leveling member, wherein the first leveling member, second leveling member, and third leveling members are the only leveling members.

12. An adjustable floor drain apparatus adapted for positioning relative to a drain pipe, the adjustable floor drain apparatus comprising:

a housing configured for positioning adjacent a drain pipe;

a frame configured to be positioned adjacent the housing;

a grate configured to be positioned at least partially above the frame; and a leveling member configured for attachment to the frame, wherein actuating the leveling member moves the leveling member relative to the grate and adjusts the position of the grate relative to the housing, wherein the frame comprises a locking block with a central bore configured to receive the leveling member wherein the housing comprises a channel configured to receive the locking block, and further comprising a plate positioned within the channel and offset from a floor of the channel, the plate comprising a cutout sized to receive a shaft of the leveling member but block passage of a head of the leveling member through the cutout.

13. The adjustable floor drain apparatus of claim 12, wherein the leveling member is a screw.

14. The adjustable floor drain apparatus of claim 12, wherein the leveling member is accessible to be actuated while the grate is secured to the frame.

15. The adjustable floor drain apparatus of claim 12, further comprising a plurality of leveling members configured for attachment to the frame, wherein actuating the plurality of leveling members in the same direction adjusts a height of the grate relative to the housing.

16. The adjustable floor drain apparatus of claim 12, wherein actuating the leveling member comprises rotating a driver connected to the leveling member.

17. The adjustable floor drain apparatus of claim 16, wherein the driver is an allen wrench.

18. The adjustable floor drain apparatus of claim 12, wherein the channel extends around a circumference of the housing.

19. A method of operating an adjustable floor drain apparatus to adjust a height of a grate of the floor drain apparatus relative to a housing of the floor drain apparatus, the method comprising:

providing a floor drain apparatus comprising:

a housing positioned adjacent a drain pipe;

a leveling frame positioned at least partially above the housing and attached to the housing;

a grate positioned at least partially above the leveling frame and secured to the leveling frame; and a first leveling member, a second leveling member, and a third leveling member;

actuating the first leveling member;

actuating the second leveling member; and actuating the third leveling member, wherein the first leveling member, second leveling member, and third leveling member are actuated while the housing is axially fixed relative to each leveling member.

20. An adjustable floor drain apparatus, the adjustable floor drain apparatus comprising:

a cylindrical collar comprising a threaded surface and configured to be positioned at least partially around a drain pipe;

a cylindrical housing comprising a threaded surface configured to engage the threaded surface of the collar;

a plurality of receiving shafts coupled with the cylindrical housing, each receiving shaft having a bottom and an open top;

a leveling frame comprising a ring and a plurality of locking blocks extending below the ring, each of the plurality of locking blocks configured to be positioned within a corresponding receiving shaft and comprising a threaded vertical bore;

a plurality of leveling members, each of the plurality of leveling members comprising a head at a first end and a threaded shaft with a tool receiving portion at a second end, each of the plurality of leveling members configured to be positioned in a respective receiving shaft of the plurality of receiving shafts with the head located between a lower end of the respective locking block and the bottom of the respective receiving shaft, and with the shaft threadably engaged within the threaded vertical bore of the locking block positioned within the respective receiving shaft; and a grate securable to the frame, the grate comprising a plurality of openings, each of the plurality of openings to be aligned with the threaded bore of a respective one of the plurality of locking blocks.

21. The adjustable floor drain apparatus of claim 20, wherein rotation of each of the plurality of leveling members causes the respective locking block to translate up or down relative to the respective leveling member.

* * * * *